US007938391B2

(12) United States Patent
Schober et al.

(10) Patent No.: US 7,938,391 B2
(45) Date of Patent: May 10, 2011

(54) APPARATUS FOR FEEDING PRINT PRODUCTS IN A CONVEYED FLOW TO A PROCESSING DEVICE

(75) Inventors: Thomas Schober, Ermatingen (CH); Peter Geiser, Matzingen (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 11/311,131

(22) Filed: Dec. 20, 2005

(65) Prior Publication Data

US 2006/0180979 A1 Aug. 17, 2006

(30) Foreign Application Priority Data

Dec. 20, 2004 (EP) ..... 04405785

(51) Int. Cl.
*B65H 5/00* (2006.01)

(52) U.S. Cl. ..... 271/3.18; 271/240

(58) Field of Classification Search ..... 271/238, 271/240, 149, 150, 151, 3.18
See application file for complete search history.

(56) References Cited

U.S. PATENT DOCUMENTS 3,690,650 A * 9/1972 Maier et al. ..... 271/211
3,945,633 A * 3/1976 Knopp ..... 271/3.12
4,089,517 A * 5/1978 Marass ..... 271/13
4,607,831 A * 8/1986 Raybuck ..... 271/240
4,618,136 A * 10/1986 Pessina et al. ..... 271/150
5,197,590 A 3/1993 Prim et al.
5,411,252 A * 5/1995 Lowell ..... 271/240
6,120,239 A * 9/2000 Roskam ..... 414/791.2
6,231,039 B1 * 5/2001 Chung ..... 270/58.01
6,419,218 B1 * 7/2002 Hartsoe et al. ..... 270/52.17
6,427,999 B1 * 8/2002 Christofferson ..... 271/201

FOREIGN PATENT DOCUMENTS

DE 102 29 322 A1 1/2004
DE 202 15 218 2/2004

* cited by examiner

*Primary Examiner* — Stefanos Karmis
*Assistant Examiner* — Michael C McCullough
(74) *Attorney, Agent, or Firm* — Venable LLP; Robert Kinberg; Ryan M. Flandro

(57) ABSTRACT

An apparatus for feeding print products, conveyed in a flow, to a processing device. The apparatus includes a feeding device including a first conveyor and a downstream-connected second conveyor. A guide arrangement is provided with side-adjustable guide members having a longitudinal center axis which constitutes the longitudinal center axis relative to the conveyed flow of print products. The print products are aligned along the guide arrangement, and the guide arrangement is configured relative to the longitudinal center axis so that it can be adjusted transverse to the conveying direction of the print products.

12 Claims, 4 Drawing Sheets

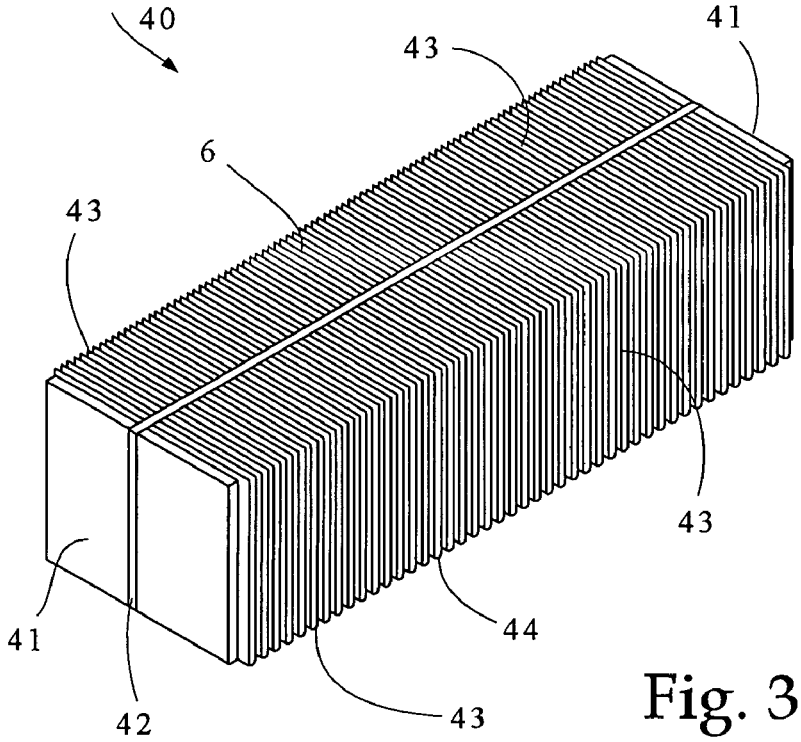
Fig. 3
Fig. 4
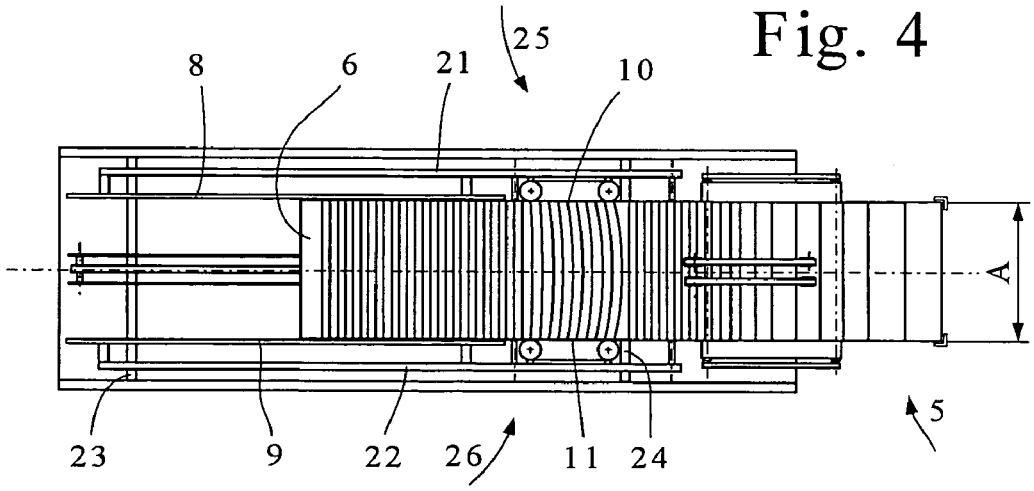

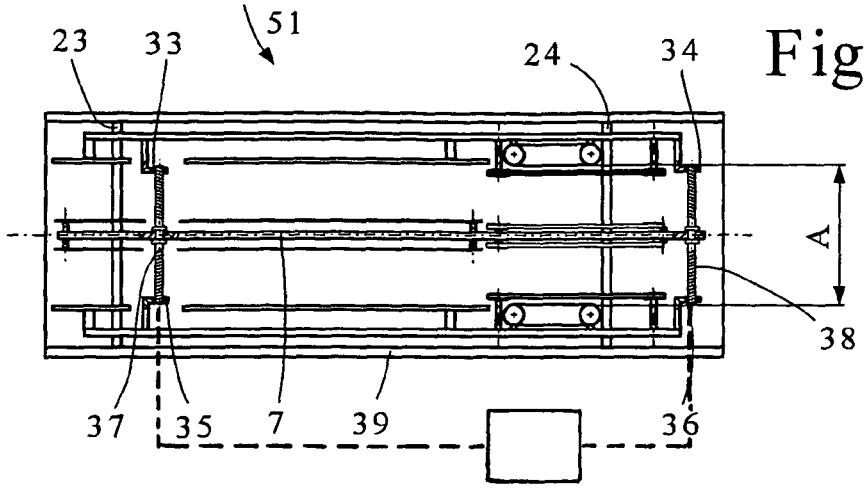
Fig. 8
Fig. 9
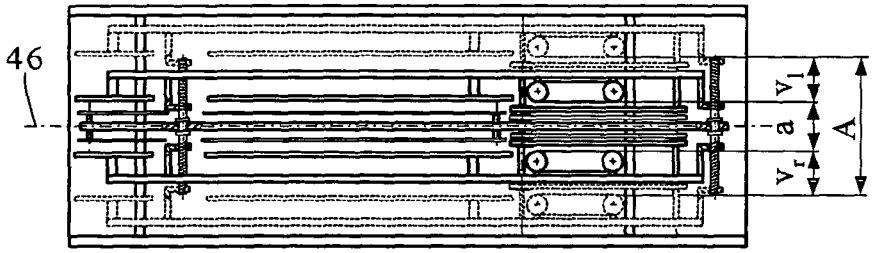
Fig. 10
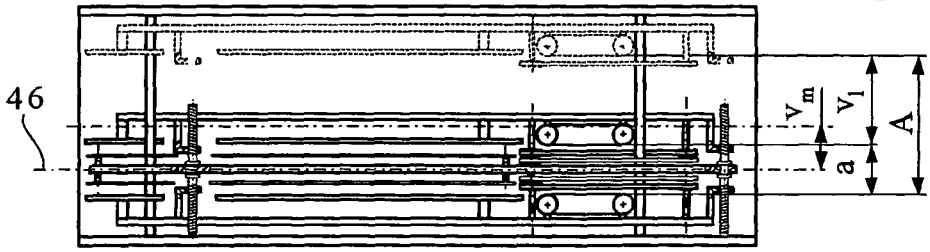
Fig. 11
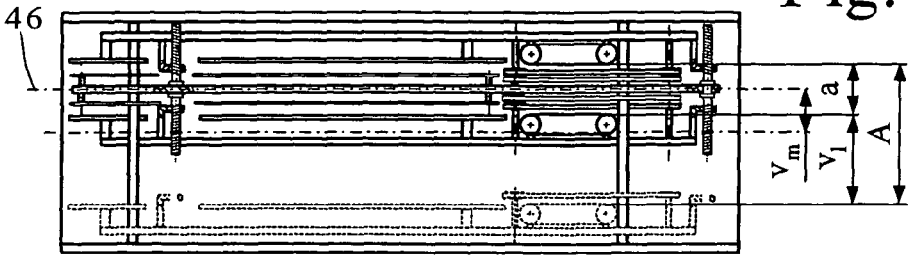

APPARATUS FOR FEEDING PRINT PRODUCTS IN A CONVEYED FLOW TO A PROCESSING DEVICE

CROSS-REFERENCE TO RELATED APPLICATION

This application claims the priority of European Application No. 04405785.9-2314, filed on Dec. 20, 2004, the subject matter of which is incorporated herein by reference.

BACKGROUND OF THE INVENTION

The invention relates to a apparatus for feeding print products in a conveyed flow to a processing device. Such an apparatus comprises an arrangement for supplying print products by a first conveyor and a following second conveyor. A guide arrangement provided with side-adjustable guide members forms a center axis in the longitudinal direction, relative to the flow of conveyed print products, wherein the print products are aligned along the guide arrangement.

Apparatuses of the aforementioned type are used to supply print products to feeder hoppers of systems used for the further processing of print products. As used herein print products are understood to include printed sheets, cards, CD/DVD-ROM, flat goods samples, and the like, which are supplied in the form of bundles and for which the dimensions can vary over a wide format range.

The overlapping function is based, for example, on the principle of frictional adherence. It is known that the frictional value between two surfaces depends on their surface condition and is subject to considerable scattering. Since the color distribution on an imprinted page is generally irregular, it can additionally be concluded that the frictional value within the surface of a print product cannot be regular. A high number of the print products is provided with a fold along at least one edge or, for other reasons, the print products do not have the same thickness across the complete surface. This results in an irregular force distribution which additionally leads to an irregular distribution of the frictional forces. To restrict the influence of the aforementioned irregularities to a degree necessary for an acceptable function, the printed sheets are aligned centrally with respect to the conveyors and the second conveyor operates only in a narrow, central section, meaning in the region where the overlapping flow is formed. The first conveyor consists of at least one driven, circulating conveying means, e.g. chains, belts, or toothed belts, wherein the conveying direction is approximately horizontal or is slightly inclined in the movement direction. The second conveyor also consists of at least one driven, circulating conveying means, for example chains, belts or toothed belts. Alternatively, the conveying means can also be embodied as a roller conveyor, comprising a plurality of driven rollers.

The first and second conveyors are drive-connected, which can be achieved either by installing a gear between the conveyors, or by using separate drives which are connected via a joint control unit.

The thickness of the conveyed flow on the second conveyor is of necessity predetermined by the speed ratio for the two conveyors relative to each other, wherein this ratio is preferably adjusted such that no gaps can develop between the print products, but that at least 2 print products will overlap and result in an overlapping flow that is as continuous as possible. Since the measurements for the print products to be processed can vary in all three dimensions, the hoppers for the further print processing machines as well as the feeding apparatuses are configured such that they can be adapted to the format.

The manner in which the format is adjusted transverse to the conveying direction for the feeding apparatus is determined by the mode of operation of the further print processing machine to be supplied, wherein three adjustment cases are known:

a) The adjustment is symmetrical (secured in the center);
b) The adjustment is exclusively on the left (secured on the right edge); or
c) The adjustment is exclusively on the right (secured on the left edge).

State of the art feeding apparatuses are configured symmetrical with respect to the format adjustment transverse to the conveying direction. The case a) is thus covered. For the cases b) and c), however, the complete conveying arrangement must be displaced to the side so that the longitudinal center axis of the conveyed flow coincides with the center axis of the products positioned inside the hopper for the further print processing machine. In principle this is possible, but it also involves an enormous expenditure in force and time since the feeding apparatus must be securely connected to the floor during the operation.

Furthermore conceivable is the installation of an alignment means between the feeding apparatus and the hopper for the further print processing machine, which alignment means pushes the print products into the correct position on the side. This solution, however, is technically very involved, is not secure with respect to process technology, and furthermore requires additional space in the conveying direction for meeting this function.

The feeding apparatus can also be divided into an immovable lower part and an upper part which can be displaced relative thereto. This solution, which is simple per se, has the serious disadvantage that the system would require more space in the transverse direction, thus occupying the empty space needed for operating the system between two adjacent feeding apparatuses.

SUMMARY OF THE INVENTION

It is an object of the present invention to create a feeding apparatus which is locally secured in place and can supply the hoppers, which are displaceable symmetrical to the conveying direction as well as to one side, of further print processing machines, while simultaneously maintaining the functional safety of a feeding apparatus according to prior art. The change in the operating mode should furthermore be easy and not require the replacement of parts.

The above and other objects are accomplished according to the invention by the provision of an apparatus for feeding print products, conveyed in a flow, to a processing device, the apparatus comprising: a feeding device including a first conveyor and a downstream-connected second conveyor; and a guide arrangement including side-adjustable guide members to form a longitudinal center axis relative to the conveyed flow of print products, wherein the print products are aligned along the guide arrangement, and the guide arrangement is configured relative to the longitudinal center axis so that it can be adjusted transverse to the conveying direction of the print products.

Thus, according to the invention, the feeding apparatus is provided with a guide arrangement, relative to the longitudinal center axis, which can be adjusted transverse to the conveying direction of the print products.

BRIEF DESCRIPTION OF THE DRAWINGS

These and other features and advantages of the invention will be further understood from the following detailed description of the exemplary embodiments with reference to the accompanying drawing, to which reference is made for all details not mentioned in the description.

FIG. 3 shows a strapped bundle consisting of print products.

FIG. 4 shows the feeding apparatus according to FIG. 2, in which a flow of conveyed print products with a maximum broadside dimension A is arranged in the center longitudinal axis of the feeding apparatus.

FIG. 8 shows a device for adjusting the feeding apparatus for processing print products with a maximum broadside dimension A in the center longitudinal axis of the conveyed flow.

FIG. 9 shows the adjustment device as shown in FIG. 8, used for the processing of print products with a small broadside dimension a, in the longitudinal center axis of the conveyed flow.

FIG. 10 shows the adjustment device according to FIG. 8, used for the processing of print products with a small broadside dimension a that are guided along a right edge; and FIG. 11 shows the adjustment device according to FIG. 8, used for the processing of print products with a small broadside dimension a, which are guided along a left edge.

DETAILED DESCRIPTION OF THE INVENTION

Figure 1:
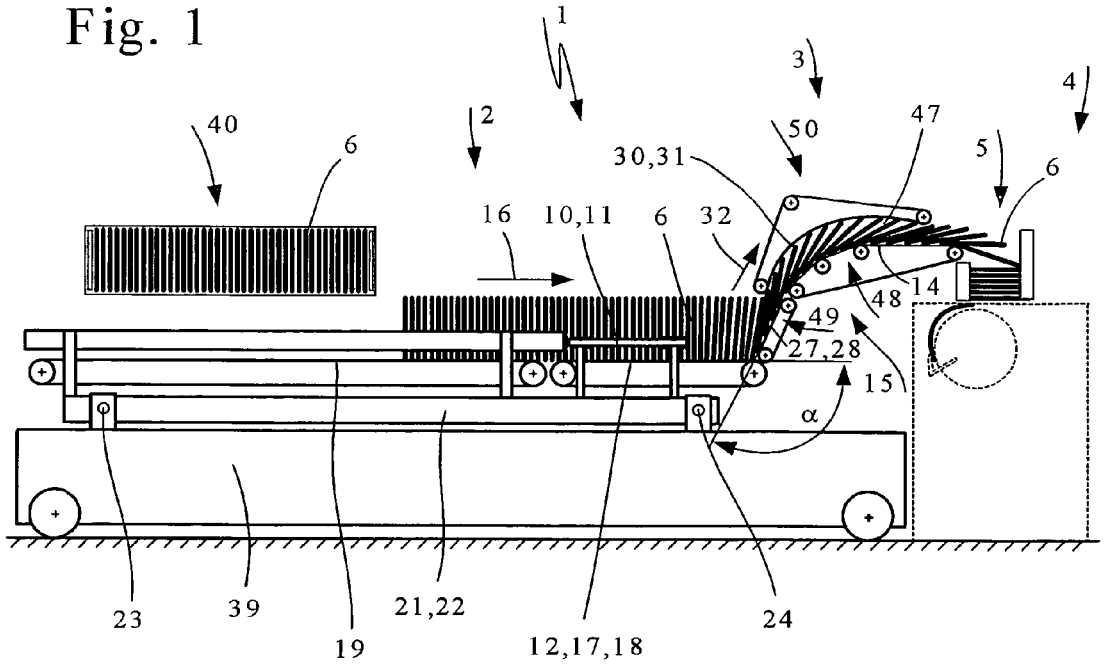
FIG. 1 is a view from the side of a feeding apparatus according to an exemplary embodiment of the invention.
Figure 2:
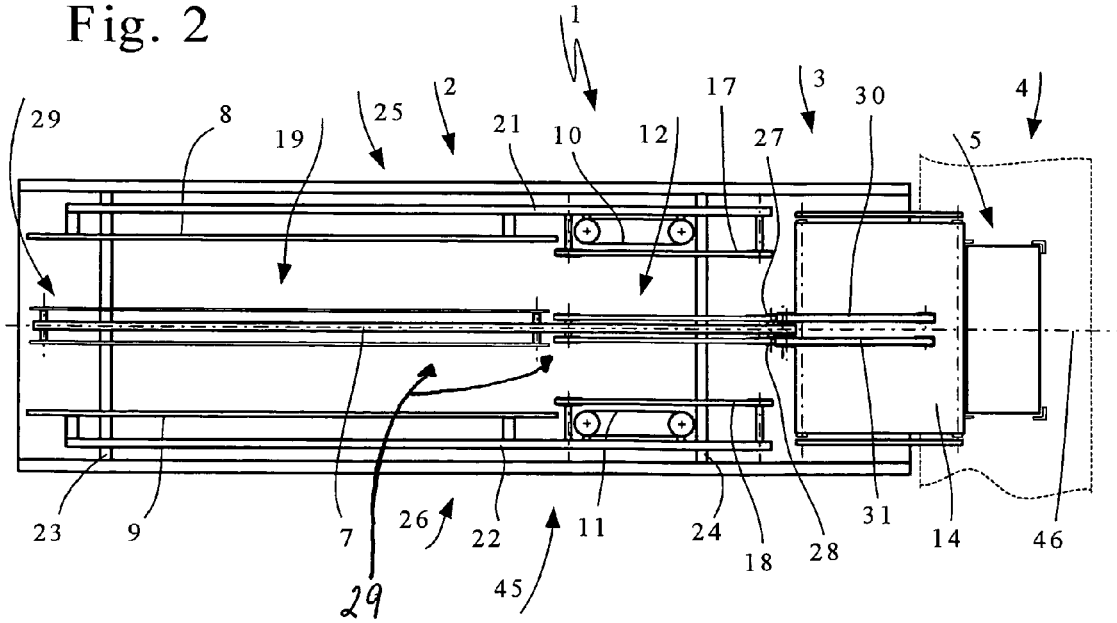
FIG. 2 is a view from above of the feeding apparatus (without print products) as shown in FIG. 1.

FIGS. 1 and 2 show a feeding apparatus 1, comprising a feeding arrangement with a first conveyor 2 and a second conveyor 3, as well as a processing device 4 with a hopper 5, which is supplied with print products 6 by the feeding apparatus 1. The print products 6 are generally delivered to the feeding apparatus 1 in the form of bundles 40.

As shown in FIG. 3, a bundle 40 consists of a long stack of upright positioned print products 6, which are provided at both ends with end boards 41 of wood, plastic or similar materials as protection for the print products 6 and which are strapped together with at least one strap 42. The print products 6 are flat articles, generally imprinted on both sides, which are provided with folds 44 along the side edges 43.

The bundles 40 are placed onto the first conveyor 2 of the feeding apparatus 1, preferably a lifting apparatus which is not shown herein, and/or they are positioned so as to adjoin the back end, in the processing direction, of the untied bundle already positioned on the first conveyor 2. Following this, the encasing strap 42 and the end boards 41 are removed. A supporting apparatus (not shown) that can be displaced in the conveying direction is provided to support the print products 6 positioned at the very back.

If the print products 6 are supplied in the form of light bundles or loose stacks, they can also be deposited manually.

The print products 6 are subsequently positioned upright on one side edge 43 on the first conveyor 2, which essentially comprises the following components:

1. a first circulating conveying element 19, attached to a support 7, on which the print products 6 are transported to a second conveyor 3 in the direction of arrow 16 while standing upright on the side edge 43;

2. side guides 8, 9 for positioning the print products 6 during the depositing of the bundles 40 and the transport of the print products 6 with the aid of a conveying element 19;

3. lateral conveying elements 10, 11, which move at approximately the same speed as the conveying element 19 in the conveying direction, between which the print products 6 can be transported;

4. conveying element 12 and guide members 17, 18, such guide members supporting the conveying elements 10, 11, during the further transport of print products 6, wherein the speed of the conveying element 12 is at least nearly as high as the speed of the conveying members 10, 11. The support 7 and conveying elements 12 and 19 constitute a conveying element 29 of the first conveyor; and 5. a drive system, not shown herein, connected to the conveying elements 10, 11, 12 and 19 and which drives these elements with the necessary operating speeds in the direction of arrow 16. A drive system of this type could, for example, consist of a mechanical gear with several outputs, respectively connected to the conveying elements 10, 11, 12, and 19, and an electric motor for driving the mechanical gear. An electronic control unit can be used to control the electric motor, such that the speed of the first conveyor is changed continuously. Individual electric drives that are controlled jointly can also be used in place of a central drive.

The first conveyor 2 is followed by a second, ascending conveyor 3. The conveying planes for the two conveyors thus form an obtuse angle $\alpha$. The second conveyor 3 transforms the stack taken from the first conveyor 2 in the conveying direction of arrow 16 into an overlapping flow 47 of horizontally conveyed print products 6, as shown with arrow 32.

The second conveyor 3 essentially comprises the following components:

1. a lower conveying system 15 which uses friction to pick up the print products 6, supplied by the first conveyor 2, in the region of their longitudinal center axis and conveys these products to the hopper 5. For the exemplary embodiment, the lower conveying system 15 in the area where the overlapping flow is formed includes a first conveying section 49, formed by belts 27, 28, and an adjoining second conveying means 14, which forms a fixed, second conveying section 48 and is embodied as a single wide belt. Several parallel belts can also be used in place of the conveying means 14. The first conveying section 49 is connected to the conveying element 29 so as to be adjustable transverse to the direction of conveyance; and 2. an upper conveying section 50, formed with belts 30, 31 which hold the print products 6 against the lower conveying system 15, wherein the upper conveying section 50 and the lower conveying system 15 are operated at the same speed. The lower conveying system 15 extends to the hopper 5 in which the conveyed print products 6 are deposited in stacks. The upper conveying section 50 is connected to be adjustable to the position of the conveying element 29.

Figure 5:
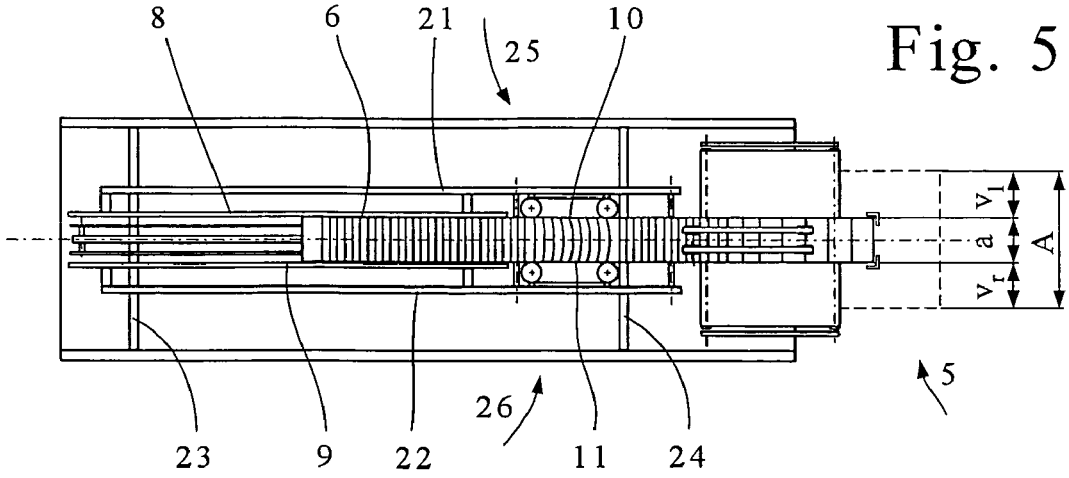
FIG. 5 shows the feeding apparatus according to FIG. 2, for a flow of conveyed print products with a small broadside dimension a, arranged along the center longitudinal axis of the feeding apparatus.

FIG. 4 shows the feeding apparatus 1 according to FIG. 2 for the processing of print products 6 with a maximum broadside A, while FIG. 5 shows the processing of print products with a small broadside a, in each case approximately in the longitudinal center axis of the feeding apparatus 1. That is to say, the longitudinal center axes of the print products 6 and/or the conveyed flow and the feeding apparatus 1 coincide, respectively independent of the broadside dimensions A, a. This can be achieved by respectively adjusting the left guide member 25 and the right guide member 26, which jointly form a guide arrangement 45 (as shown in FIGS. 2, 4 and 5)), in opposite directions by half the adjustment distance $v_1=v_r=(A-a)/2$, where $v_1$ is the left side distance and $v_r$ is the right side distance in the conveying direction. For this, the left guide member 25 in the conveying direction is formed with the support 21 and the conveying element 10 and guide member 17 attached thereto, as well as the left side guide 8. The right guide member 26 in the conveying direction is formed with the support 22 and the conveying means 11 and guide member 18 attached thereto, as well as the right side guide 9. The supports 21, 22 are positioned so as to be displaceable on rails 23, 24 which are fixedly connected to a machine frame 39. The conveying element 29, consisting of the support 7 and the conveying elements 12 and 19 attached thereto, is also positioned on the rails 23, 24, but is positioned immovably with respect to the machine frame 39 for this operating mode.

Figure 6:
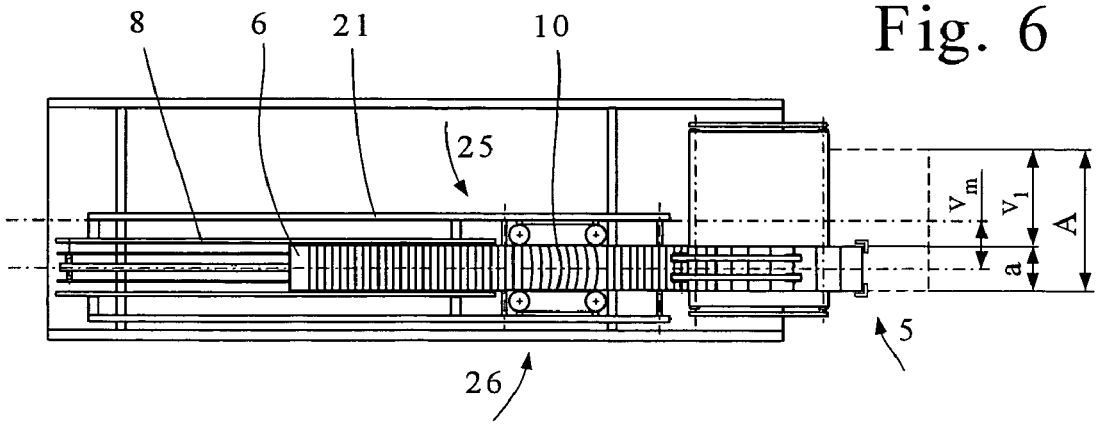
FIG. 6 shows the feeding apparatus according to FIG. 2, wherein the flow of print products with a small broadside dimension a are guided along a right edge in the conveying direction.

FIG. 6 shows the feeding apparatus 1 in the operating mode where the edge is secured on the right, with adjustment to a smaller broadside dimension a. For the adjustment to a maximum broadside dimension A, the positions of the guide members 25, 26 are the same as for an operating mode in the center, as shown in FIG. 4. For the adjustment to a smaller broadside dimension a, only the left guide member 25 is displaced according to FIG. 6 by the complete difference $v_1=A-a$. In addition, the conveying element 29 is displaced by half the difference $v_m=(A-a)/2$. As a result, the longitudinal center axis 46 for the products with broadside dimension a still coincides with the center axis of the conveying element 29, which is located in the center between the two guide members 25, 26. Support 7 is positioned on the rails 23, 24, such that it can be displaced to the side and can be secured in position relative to the machine frame for the adjustment to the maximum broadside dimension A.

Figure 7:
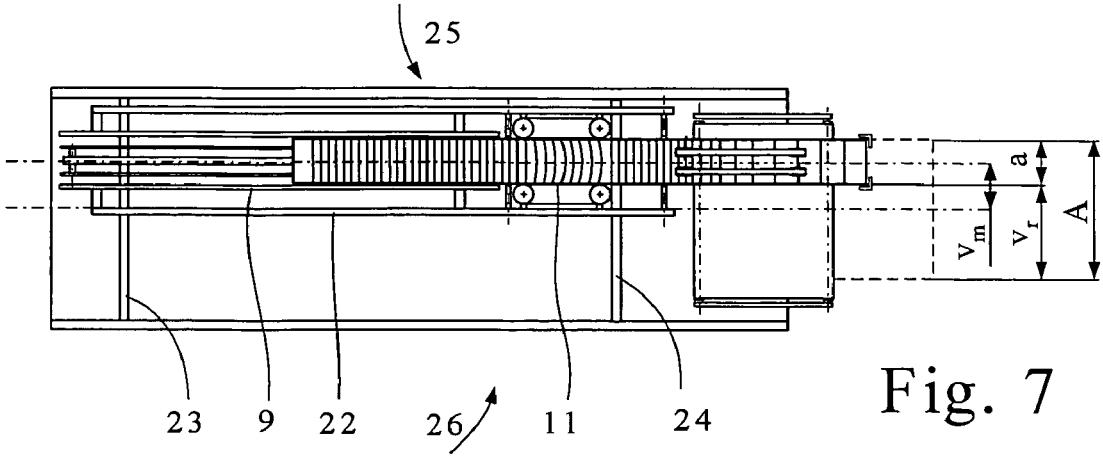
FIG. 7 shows the feeding apparatus according to FIG. 2, in which a flow of print products with a small broadside dimension a are guided in the conveying direction along a left edge.

FIG. 7 shows the feeding apparatus 1 in the operating mode where the left edge is secured for the adjustment to a smaller broadside dimension a. This mode of operation is identical to the mode of operation where the edge is secured on the right, with the difference that in this case, the right guide member 26 is displaced by the complete difference A−a to the side and that the left guide member 25 remains in the same position.

FIG. 8 shows an adjustment device 51 in the position for processing a print product with a maximum broadside dimension A. Drive-connected spindles 37, 38 are positioned in the support 7, which are respectively provided on one side with a left thread and on the opposite side with a right thread. The thread portions of the spindles 37, 38 extend into nuts 33, 34, 35, 36 of the supports 21, 22, which belong to the guide members 25, 26. The spindles can be operated manually or with the aid of a motor, wherein the guide members 25, 26 respectively approach the support 7 or move away from it by the same distance, depending on the direction of rotation. For a center adjustment, the support 7 is fixedly connected to the rails 23, 24 on which the supports 21, 22 slide along. The connection between the supports 7, 21, 22 and the rails 23, 24 can be embodied as a simple clamping connection, wherein electrically, pneumatically, or hydraulically operated systems are conceivable as well. For example, spindles 37, 38 may be driven by a controlled servomotor 52 as graphically depicted in FIG. 8.

FIG. 9 shows the situation for a central mode of operation and a position for processing a smaller broadside dimension a. To achieve this position, the guide members 25, 26 have respectively moved toward each other by $v_r=v_1=(A-a)/2$.

FIG. 10 shows the situation for the mode of operation where the edge is secured on the right and a position for processing a smaller broadside dimension a. The starting position was the same as for the central mode of operation for processing products 6 with maximum broadside dimension A. In this position, the support 22 is connected to the rails 23, 24 and the support 7 as well as the support 21 can be displaced on the rails 23, 24. The displacement distance for the guide member 25 is $v_1=A-a$, and for the support 7 of the conveying element 29 the displacement distance is $v_m=(A-a)/2$.

FIG. 11 shows the situation for the mode of operation for processing a smaller broadside dimension a, for which the left edge is secured. The operational steps used are analog to the steps for the mode of operation where the right edge is secured, but with the sides reversed.

Each support 7, 21, 22 can furthermore be adjusted by separate spindles, which are positioned in the machine frame 39 and can be operated manually or with the aid of a motor. The displacement distances, which depend on the mode of operation and the format, are preferably computed in the machine control and are displayed as desired values on a display apparatus or are transmitted to adjustment drives.

It will be understood that the above description of the present invention is by way of example and is susceptible to various modifications, changes and adaptations, and the same are intended to be comprehended within the meaning and range of equivalents of the appended claims.

What is claimed is:

1. An apparatus for feeding print products, conveyed to a processing device, the apparatus comprising:

a machine frame;

a feeding device coupled to the machine frame, the feeding device including a first conveyor and a downstream-connected second conveyor, the first conveyor conveying a stack of print products in a conveying direction toward the downstream-connected second conveyor, the second conveyor transforming the stack taken from the first conveyor into an overlapping flow in the conveying direction;

a guide arrangement associated with the first conveyor and including side-adjustable guide members to align the stack of the print products, the guide members having a longitudinal center axis coinciding with a longitudinal center axis of the conveyed flow of print products;

a support coupled to the machine frame which runs along the longitudinal center axis of the conveyed flow and moves with shifting of the longitudinal center axis of the conveyed flow;

a spindle drive connected to the support to adjust a position of the support and the longitudinal axis of the conveyed flow transversely to the conveying direction;

a controlled servomotor drivingly connected to the spindle drive to adjust the support and guide members, wherein the controlled servomotor adjusts the guide members of the guide arrangement transversely to move the longitudinal center axis of the guide members relative to the direction of the conveyed flow of print products and the controlled servomotor adjusts the guide members symmetrically with respect to the longitudinal center axis of the conveyed flow.

2. The apparatus as defined in claim 1, wherein the downstream-connected second conveyor comprises a locally fixed conveying section and a preceding ascending conveying section.

3. The apparatus as defined in claim 2, wherein a center of the preceding conveying section coincides with the longitudinal center axis of the conveyed flow.

4. The apparatus as defined in claim 2, wherein the first conveyor includes a conveying element arranged in a center between the side-adjustable guide members, and the preceding conveying section of the downstream-connected second conveyor is connected to the conveying element so as to be adjustable.

5. The apparatus as defined in claim 4, wherein the downstream-connected second conveyor includes a lower conveying element and an upper conveying element which acts upon the flow of print products conveyed on the lower conveying element, wherein the upper conveying element is connected to be adjustable to a position of the conveying element of the first conveyor.

6. The apparatus as defined in claim 1, wherein at least one of the support and one of the guide members can be secured on the machine frame.

7. The apparatus as defined in claim 1, wherein respectively one of the guide members is positioned according to a position of the processing device.

8. The apparatus as defined in claim 1, wherein the print products are conveyable in a horizontal position or an upright position on the first conveyor.

9. The apparatus as defined in claim 1, further comprising a downstream hopper displaceable symmetrical to the conveying direction as well as to a side, wherein the second-downstream conveyor conveys the overlapping flow to the hopper and wherein the guide members are adjustable by the servomotor to align the overlapping flow with a position of the hopper.

10. The apparatus as defined in claim 1, wherein a thickness of the conveyed flow on the second conveyor is predetermined by a speed ratio for the first conveyor and the second conveyor relative to each other which minimizes gaps between the print products.

11. An apparatus for feeding print products, conveyed to a processing device, the apparatus comprising:

a machine frame;

a feeding device coupled to the machine frame, the feeding device including a first conveyor and a downstream-connected second conveyor, the first conveyor conveying a stack of print products in a conveying direction toward the downstream-connected second conveyor, the second conveyor transforming the stack taken from the first conveyor into an overlapping flow in the conveying direction;

a guide arrangement associated with the first conveyor and including side-adjustable guide members coupled to the machine frame to align the stack of the print products, the guide members having a longitudinal center axis coinciding with a longitudinal center axis of the conveyed flow of print products;

a support coupled to the machine frame which runs along the longitudinal center axis of the conveyed flow and moves with shifting of the longitudinal center axis of the conveyed flow;

a spindle drive connected to the support to adjust a position of the support and the longitudinal axis of the conveyed flow transversely to the conveying direction;

wherein the guide members of the guide arrangement transversely move the longitudinal center axis of the guide members relative to the direction of the conveyed flow of print products and the guide members adjust symmetrically with respect to the longitudinal center axis of the conveyed flow.

12. The apparatus as defined in claim 11, further comprising a controlled servomotor drivingly connected to the spindle drive to adjust the support and guide members.

* * * * *